United States Patent [19]

Kuhl et al.

[11] 4,233,791

[45] Nov. 18, 1980

[54] VAPOR IMPERMEABLE INSULATION FACING CONSTRUCTION

[76] Inventors: LeRoy L. Kuhl, 1101 - 31st St., West Des Moines, Iowa 50265; Lester L. Thompson, P.O. Box 603, Montezuma, Iowa 50171

[21] Appl. No.: 10,713

[22] Filed: Feb. 9, 1979

[51] Int. Cl.[3] ..... E04B 1/74; E04B 7/00

[52] U.S. Cl. ..... 52/309.1; 52/404; 52/410; 52/743; 52/748; 156/71

[58] Field of Search ..... 52/404, 407, 406, 410, 52/748, 222, 743, 22, 481, 309.1; 156/71; 160/383, 387; 428/83, 121, 122

[56] References Cited

U.S. PATENT DOCUMENTS

| | | | |
|---|---|---|---|
| 1,193,092 | 8/1916 | Webb | 52/481 |
| 1,914,345 | 6/1933 | Roos . | |
| 1,959,519 | 5/1934 | Black | 52/748 |
| 2,264,976 | 12/1941 | Heritage | 52/406 X |
| 2,305,008 | 12/1942 | Howard | 52/528 X |
| 2,928,463 | 3/1960 | Pierson | 428/121 X |
| 2,943,676 | 7/1960 | Grenci | 160/387 X |
| 3,121,649 | 2/1964 | Oliver | 52/748 X |
| 4,075,807 | 2/1978 | Alderman | 52/743 X |
| 4,077,683 | 3/1978 | Smith | 52/408 X |
| 4,147,003 | 4/1979 | Alderman | 52/404 X |

FOREIGN PATENT DOCUMENTS

| | | | |
|---|---|---|---|
| 2301912 | 8/1973 | Fed. Rep. of Germany | 156/71 |
| 1204362 | 9/1970 | United Kingdom | 156/71 |

*Primary Examiner*—Alfred C. Perham
*Attorney, Agent, or Firm*—Henderson & Sturm

[57] ABSTRACT

Vapor impermeable reinforced facing material is cut into longitudinal rectangular sheets and further reinforced by metal straps sealed in the facing material along the edges of the sheets, the sheets are attached in an overlapping manner to ceiling purlins by screws drilled into the purlins through the metal reinforcing straps which run down the longitudinal edges of the sheets. The ends of the sheets are attached to the I-beams, which support the ends of the purlins, by screws drilled into the beams through metal reinforcing straps which run along the transverse edges of the sheets.

12 Claims, 10 Drawing Figures

VAPOR IMPERMEABLE INSULATION FACING CONSTRUCTION

BACKGROUND OF THE INVENTION

The present invention pertains to vapor barriers used to prevent vapor intrusion into insulation. Vapor barriers keep moisture from condensing inside insulation which otherwise would cause it to lose much of its insulating value.

The roof structure of an industrial building is typically comprised of parallel pulins mounted at the ends on horizontal I-beams which are supported by vertical columns. As U.S. Patent No. 4,075,807 sets forth, generally, insulation is either laid across the top of the purlins perpendicular thereto, with sheets of rigid roofing material then attached to the purlins through the insulation, or laid in between the purlins, and parallel to them, on top of an underlying support framework which is attached to the purlins. In either case, the underside of the insulation is laminated with a vapor impermeable facing to minimize vapor intrusion. Such a laminated vapor impermeable facing is, by itself, an ineffective vapor barrier, inasmuch as vapor can leak through the seams between adjacent sheets of insulation, or between the sheets of insulation and the purlins.

The present invention eliminates all such vapor leaks by providing a continuous vapor impermeable surface to underlie the insulation. Additionally, the instant invention provides a facing construction which securely supports the overlying insulation.

The instant invention is a vapor barrier facing construction which is installed on the underside of ceiling purlins, to both support overlying layers of insulation, which are installed between the purlins, and protect the insulation from vapor intrusion by providing a continuous vapor impermeable surface across the entire ceiling.

The invention utilizes a facing material which is both vapor impermeable and sufficiently strong to support the overlying insulation. The facing material is installed on adjacent purlins in rectangular sheets which are locally reinforced along the longitudinal edges by metal strips sealed in the facing material. The longitudinal sides of the sheets are attached to the purlins along their reinforced edges in an overlapping manner. The ends of the sheets are secured again along their reinforced edges to the beams supporting the purlins. Thus, a continuous vapor impermeable surface is created which is securely fastened along the edges of the ceiling, and contains no joint or seam which is vulnerable to vapor leak. Moreover, the facing construction solidly supports overlying insulation which is installed on top of it.

The present invention therefore comprises a highly effective vapor barrier which increases insulation efficiency, and hence, conserves energy.

SUMMARY OF THE INVENTION

The present invention comprises a vapor impermeable facing construction installed on the underside of ceiling purlins. The facing material utilized is both vapor impermeable and sufficiently strong to support overlying layers of insulation. The facing is applied in rectangular sheets running parallel to adjacent purlins and covering the space between them. Metal reinforcing straps are sealed in the facing material along the edges of these sheets. Adjacent to each of these metal reinforcing straps a strip of double-faced tape is applied. Release paper preserves the adhesive quality of the upward face of the tape until it is removed to attach the sheets to the purlins. With the release paper removed, the exposed upper face of the tape is applied to the bottom side of a purlin. The tape running along the opposite side of the sheet is in a like manner applied to the adjacent purlin. Hence, the sheet is very easily temporarily secured to the purlins. With the facing sheet, thus, conveniently positioned, permanent fasteners are installed into the purlins through the reinforcing straps sealed along the sides of the sheet. The facing sheets are always attached to the outer portions of adjacent purlins to permit subsequently installed sheets to overlap, forming lap joints at all purlins intermediate the two outermost ones. This overlapping joint construction prevents vapor leak. At the ends of the purlins, the facing is secured to the horizontal beams which support the purlins. Normally, I-beams are used for this purpose, and in such a case, the end of the sheet would be secured to the underside of the top flange of the beam. Again, the sheet is first secured to the beam by tape, and then permanent fasteners are installed into the beam through the metal reinforcing straps sealed along the end of the facing. Therefore, the facing construction is securely fastened along the edges of the ceiling, as well as at the purlins. Layers of insulation can now be installed between the purlins, and they will be securely supported by a facing construction which ensures a continuous vapor impermeable surface without a facing seam vulnerable to admitting vapor into the overlying insulation. Thus, the condensation of water vapor within the insulation is prevented, and the continuing effectiveness of the insulation guaranteed.

An object of this invention is to provide a facing construction applied to the bottom of ceiling purlins which will support overlying layers of insulation, and provide a continuous vapor impermeable surface across the entire ceiling area to underlie the insulation, and thereby, protect it from vapor intrusion.

It is a further object of this invention to provide a method for installing a facing construction to the underside of purlins which supports overlying layers of insulation, and protects them from vapor intrusion by providing a continuous vapor impermeable surface across the entire ceiling area to underlie the insulation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
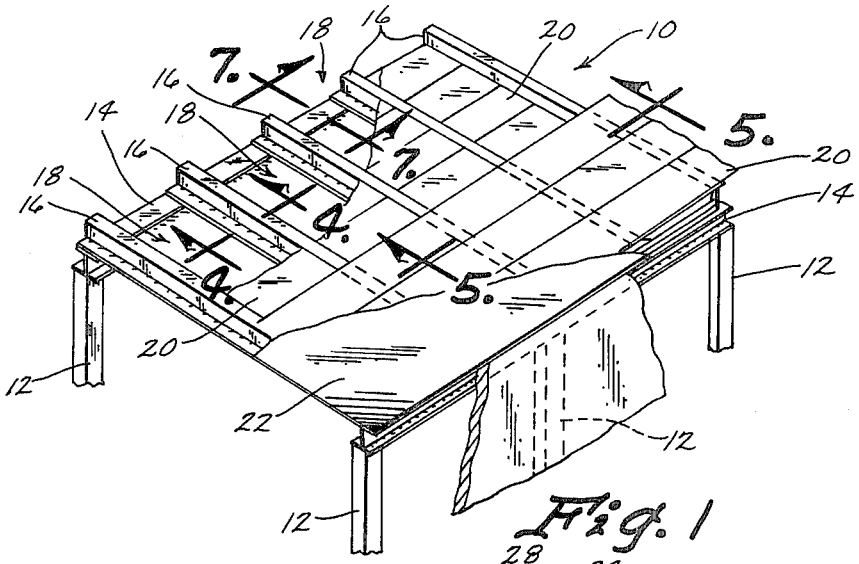
FIG. 1 is a perspective view of a building using the vapor impermeable insulation facing construction of the instant invention.

Referring now to the drawings, wherein like reference numerals designate identical or corresponding parts throughout the several views, FIG. 1 shows a typical bay 10 of an industrial building utilizing the vapor impermeable insulation facing construction 11 of the instant invention. The bay 10 is formed by a series of vertical columns 12 which support horizontal I-beams 14, which in turn support a plurality of parallel purlins 16. Each adjacent pair of parallel purlins 16 defines a rectangular purlin bay 18.

The facing construction 11 covers the entire ceiling area and underlies and supports insulation 20; and a rigid roofing material 22 is disposed over the insulation 20 and purlins 16, thereby enclosing the insulation 20 between facing construction 11 and roofing material 22.

The reinforced vapor impermeable facing construction 11 is best understood through a description of the method of installation. The first step in installing the facing construction 11 is to measure the length and width of the purlin bays 18. Facing material 24 is then cut into rectangular sheets suitable to cover each of the purlin bays 18, allowing for additional material along the edge of each facing sheet as necessary for the later attachment of metal reinforcing straps 26. The facing material 24, as well as being vapor impermeable, must be sufficiently strong to support the weight of overlying insulation 20. Accordingly, vinyl reinforced polyester has been chosen, but it is understood that other materials would also be suitable.

Figure 2:
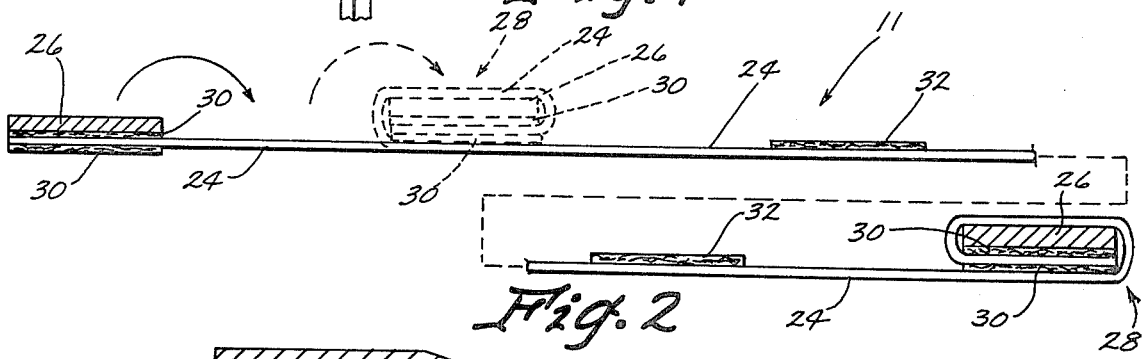
FIG. 2 is a broken sectional view of a partially completed sheet of reinforced facing.

Once the facing material 24 has been sized and cut, metal reinforcing straps 26, herein three-quarter inch metal bands, are sealed in the facing material 24 along the edges of the cut sheet as shown in FIG. 2. It is understood that the reinforcing straps 26 could also be constructed of other rigid materials such as plastic.

A metal reinforcing strap 26 is placed along longitudinal edge of the facing material 24. The reinforcing strap 26 is then rolled in the facing sheet 24 to form a strap envelope 28 as shown by the dotted lines in FIG. 2. The strap envelope 28, thus formed, is secured by a strip of double-faced tape 30 which extends along the full length of facing sheet 24 parallel to the edge thereof. It is understood that tape 30 could also be used to hold strap 26 in position while the strap envelope 28 is being formed, as is shown in FIG. 2. Strap envelopes 28 are likewise formed along the other longitudinal edge and the transverse edges of facing sheet 24, thus forming a rectangular reinforced border on facing sheet 24. Parallel to and interior of the rectangular reinforced border formed by strap envelopes 28, an additional strip of double-faced tape 32 is applied to facing material 24, thus forming an inner rectangle. This completes the reinforced facing construction 11.

Figure 3:
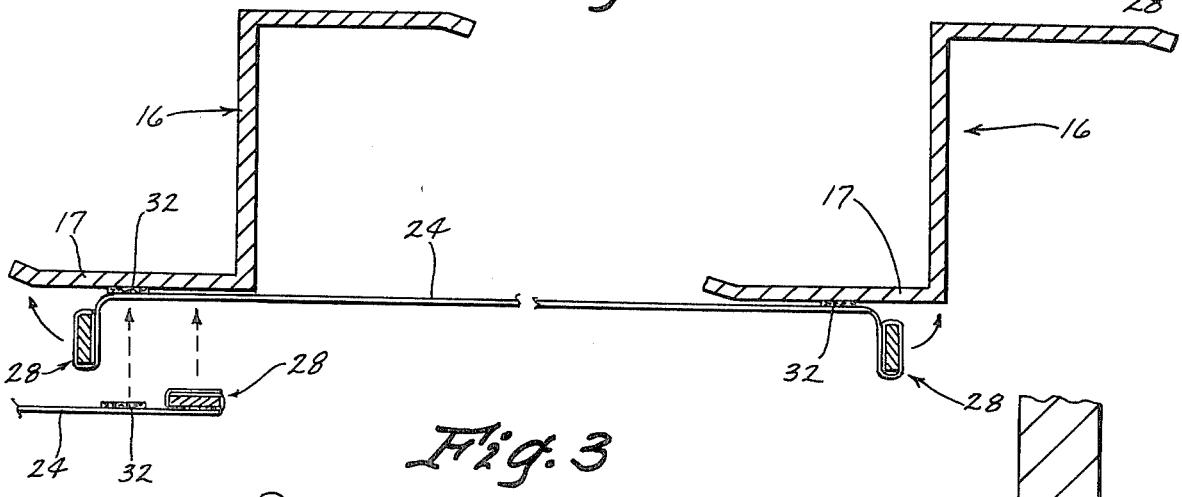
FIG. 3 is a cross-sectional elevational view of a reinforced facing sheet temporarily secured to adjacent purlins by means of double-faced tape.

The remaining presized and cut facing material sheets 24 are likewise reinforced by a rectangular border of strap envelopes 28, and double-faced tape 32 is applied as described above. The reinforced facing construction 11 is then applied to the lower flanges 17 of purlins 16 as shown in FIG. 3. The release paper (not shown) of double-faced tape 32 is removed and the tape 32 is affixed to the outer portion of the bottom side of flanges 17, thereby temporarily securing the reinforced facing construction 11 between and along the length of the parallel purlins 16 while the strap envelopes 28 depend freely downward.

Figure 4:
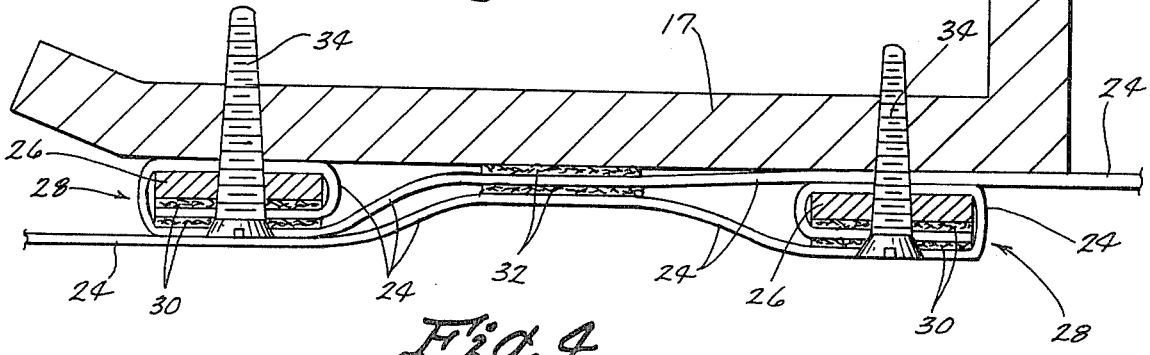
FIG. 4 is an enlarged cross-sectional view taken along line 4—4 of FIG. 1 and showing a typical joint between overlapping sheets of reinforced facing permanently secured to a purlin.

Permanent fasteners or Tek screws 34, having a drill bit point suitable for penetrating the purlins 16, are drilled through the strap envelopes 28, and thus through reinforcing straps 26 and into the lower flanges 17 of purlins 16, as shown in FIG. 4. The screws 34 are drilled along the longitudinal center of reinforcing straps 26 and are uniformly spaced in sufficient number to support the overlying insulation 20.

Figures 5, 6, 7, 8, 9, 10:
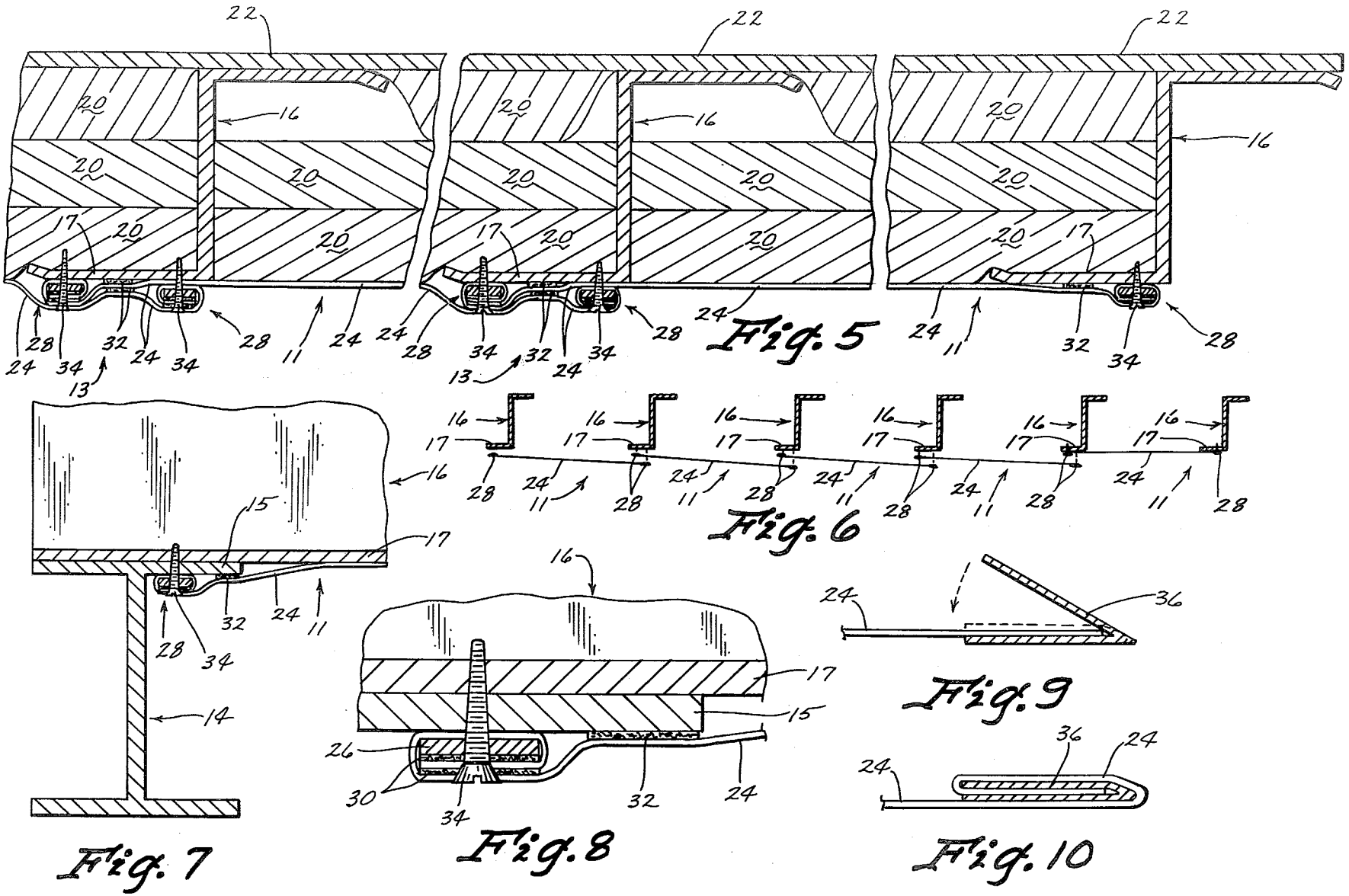
FIG. 5 is a broken cross-sectional view taken along line 5—5 of FIG. 1 showing reinforced facing sheets permanently secured to purlins in an overlapping manner, with insulation installed between the purlins.
FIG. 6 is an exploded elevational view showing symbolically the instant facing construction installed in an overlapping manner on the purlins.
FIG. 7 is a cross-sectional view taken along line 7—7 of FIG. 1 showing a purlin and supporting I-beam, with reinforced facing secured to the underside of the top flange of the beam.
FIG. 8 is an enlarged cross-sectional view showing the attachment of the transverse edge of the facing sheet as in FIG. 7.
FIG. 9 is a sectional view of an alternative embodiment of the reinforcing member of the present invention.
FIG. 10 is a cross-sectional view of the alternative embodiment of the reinforcing member shown in FIG. 9 wherein the reinforcing member is clamped to a closed position upon the edge of the facing and rolled to form an envelope.

As most clearly shown in FIGS. 4 and 5, the strap envelopes 28 are secured by screws 34 to the outer portion of lower flanges 17 of purlins 16. Attachment of the reinforced facing construction 11 in this manner permits subsequently installed reinforced facing construction sheets 11 to overlap so that the facing construction sheets 11 form lap joints 13.

The right-hand side of FIG. 5 shows the first reinforced facing construction sheet 11 attached at one side of a typical bay 10. A second reinforced facing sheet 11 is next temporarily secured to the next pair of adjacent parallel purlins 16 by means of double-faced tape 32. The tape 32 of the second sheet 11 adheres to the underside of the left-hand edge portion of the first sheet 11, and therefore, is not directly in contact with purlin 16 since the bottom flange 17 of purlin 16 has been substantially covered by the first sheet 11. After the second sheet 11 has been temporarily secured by tape 32, it is then permanently fastened to the outer portions of the adjacent purlins 16 by screws 34. Thus, the lap joints 13 forms a vapor impermeable structure at the purlins 16.

The remaining reinforced facing sheets 11 are likewise attached to the purlins 16 in an overlapping manner, as symbolically illustrated in FIG. 6. Thus, all purlins 16 located intermediate of the two outermost purlins located at the sidewalls of the building, include overlapping facing joints or lap joints 13. This overlapping, reinforced construction provides a continuous vapor impermeable barrier from one side of the building to the other.

To prevent vapor intrusion at the ends of the purlins 16 supported by I-beams 14, the facing sheets 11 are attached to the underside of top flanges 15 of I-beams 14, as shown in FIGS. 7 and 8. The facing sheet 11 is first temporarily secured by tape 32 to the underside of top flange 15. The strap envelope 28 is then permanently secured by screws 34.

With the reinforced facing sheets 11 thus fastened along the edges of the ceiling, and by means of overlapping facing joints or lap joints 13 at all intermediate purlins 16, a continuous vapor impermeable surface is provided along the entire ceiling area. Insulation 20 can now be installed between the purlins 16, being supported by the installed reinforced facing sheets 11.

FIG. 5 shows insulation 20 in place above and supported by the facing material 24 of facing sheets 11. Two layers of insulation 20 are cut to fit between and perpendicular to the purlins 16. The uppermost layer of insulation 20 is then laid across the tops of the purlins 16 perpendicular thereto. Rigid roofing material 22 is then installed over the purlins 16 and insulation 20 and is fastened to the purlins 16 through the uppermost layer of insulation 20. It is understood that the number of layers of insulation 20 can vary depending on the thickness or the insulation 20 could be loose insulation. This completes the installation, with the reinforced, overlapping, vapor impermeable facing construction both supporting the overlying insulation 20, and protecting it from vapor intrusion.

As an alternative embodiment of the present invention is illustrated in FIGS. 9 and 10. In this embodiment, metal angle straps 36 are used to reinforce the facing material 24 rather than a metal strap 26. An edge of a facing material 24 is inserted into the V-shaped angle strap 36. The angle strap 36 is then crimped to a closed position by a suitable tool, pinching the facing material 24 as shown by the dotted lines in FIG. 9. The other edges of the facing material 24 are reinforced by angle straps 36 in the same manner. The remainder of the installation and construction is identical to that set forth for the previous embodiment except that angle strap 36 is rolled up in the facing material 24 just prior to installing permanent fasteners 34 as shown in Fig. 10.

Obviously, many modifications and variations of the present invention are possible in light of the above teachings. It is therefore to be understood that, within the scope of the appended claims, the invention may be practiced otherwise than as specifically described.

We claim:

1. In a roof structure which includes a number of ceiling purlins supported at their ends by horizontal beams, a continuous vapor impermeable facing construction attached to said purlins and said beams which supports overlying layers of insulation and prevents vapor from passing through said facing construction and into said insulation, said facing construction comprising:

a facing material, wherein said facing material is both vapor impermeable and sufficiently strong to support the weight of overlying insulation, said facing material being formed into a number of rectangular sheets, each of said rectangular sheets being suitable in width to extend between an adjacent and parallel pair of said purlins, and suitable in length to extend from one end of said purlins to the other, said rectangular facing sheets being joined together at said purlins to cover the ceiling area spanned by said purlins;

a number of reinforcing members attached to said facing sheets along the portions where said facing sheets are attached to said purlins, and also along the portions where said facing sheets are attached to said beams, each of said rectangular facing sheets having a pair of longer sides and a pair of shorter ends, one of said reinforcing members being attached along each of the sides and each of the ends of each of said rectangular facing sheets; and permanent fastening means, wherein said permanent fastening means attach said rectangular facing sheets, through said reinforcing members, to said purlins and said beams, each of said purlins having a lower flange such as is included in a C or a Z type purlin, and wherein when an adjacent pair of said purlins are viewed together, each of the bottom sides of the lower flanges of said pair of purlins has an outer portion, said rectangular facing sheets being attached to the outer portions of the bottom sides of the lower flanges of said purlins to permit said rectangular facing sheets to overlap when connected to a common purlin to create an overlapping facing joint, said overlapping facing joint being impervious to vapor, and thus, preventing vapor from passing through said overlapping facing joint.

2. The facing construction of claim 1 wherein each of said beams supporting the ends of said purlins is an I-beam having an upper flange, the end of said rectangular facing sheet being attached to the bottom side of the upper flange of said I-beam by said permanent fastening means installed through said reinforcing member attached along the end of said rectangular facing sheet.

3. The facing construction of claim 2 further comprising a number of strips of double-faced tape applied to each of said rectangular facing sheets adjacent to said reinforcing members, attached along the sides and ends of said rectangular facing sheets, said tape having an upper and a lower adhesive face, the lower adhesive face adhering said tape to said facing material, the upper adhesive faces applied to an adjacent pair of said purlins, thereby conveniently positioning said rectangular facing sheet to permit the installation of said permanent fastening means, along the sides of said facing sheet, through said reinforcing members, and into said pair of purlins, the remaining rectangular facing sheets being installed on the purlins in the same manner, joining to cover the entire ceiling area spanned by the purlins.

4. The facing construction of claim 2 wherein said facing construction supports the weight of overlying insulation.

5. The facing construction of claim 2 wherein said facing material is vinyl reinforced polyester.

6. The facing construction of claim 2 wherein said permanent fastening means are drill point screws.

7. The facing construction of claim 2 wherein each of said reinforcing members is a metal reinforcing strap.

8. The facing construction of claim 7 wherein each of the sides and ends of said rectangular facing sheets are formed into an envelope suitable to extend around and envelop one of said metal reinforcing straps, said reinforcing strap envelope sealing said metal reinforcing strap within said facing material.

9. The facing construction of claim 8 wherein said metal reinforcing strap is ⅜inch in width.

10. The facing construction of claim 2 wherein each of said reinforcing members is an angle strip having two side members joined along one edge, and movable between an open and a closed position, whereby said side members remain in a V-shaped configuration in said open position, an edge of said rectangular facing sheet is inserted into said angle strip in said open position, said angle strip then being crimped to said closed position by a suitable tool wherein said angle strip then remains in said closed position after said tool has been removed without further application of exterior force, said rectangular facing sheet being pinched between said sides in said closed position, said rectangular facing sheet being thereby secured in said angle strip, said angle strip being in the same manner installed along each of the sides and ends of each of said rectangular facing sheets, said angle strips thereby reinforcing the sides and ends of said rectangular facing sheets, said angle strip then being rolled towards the center of said rectangular facing sheet so that said facing material extends around said angle strip in an enclosed position, said rectangular facing sheets being attached to said purlins by said permanent fastening means installed through said angle strips in said enclosed position.

11. In a roof structure which includes a number of parallel ceiling purlins supported at their ends by horizontal beams, a method for installing a vapor barrier, to underlie and support insulation installed between said purlins, constructed from a number of sheets of a facing material which is both vapor impermeable and sufficiently strong to support overlying insulation, a number of reinforcing members, a number of strips of double faced adhesive tape, and permanent fastening means, which comprises the steps of:

(a) forming said facing material into a number of rectangular sheets, each of said rectangular sheets having a pair of longer sides and shorter ends, said rectangular sheets being suitable in width to extend between an adjacent pair of said purlins, and suitable in length to extend from one end of said pair of purlins to the other, the widths and length of said rectangular facing sheets allowing additionally for the attachment of a reinforcing member along each of the sides and ends of said rectangular facing sheets, said rectangular facing sheets when attached to said purlins covering the entire ceiling area spanned by said purlins;

(b) attaching said reinforcing members along each of the sides and ends of said rectangular facing sheets;

(c) applying strips of said tape along each of the sides and ends of said rectangular facing sheets, said tape being applied adjacent to said reinforcing members, a longer strip of said tape running down each side of each of said rectangular facing sheets, and a shorter strip of said tape running across each end of each of said rectangular facing sheets, said tape having an upper and a lower adhesive face, the upper adhesive face adhering said tape to said facing material;

(d) temporarily securing a first rectangular facing sheet along the sides thereof to a first pair of said purlins by applying the upper adhesive face of the longer strips of said tape, running down the sides of said first rectangular facing sheet, to the undersides of said first pair of purlins so that said first rectangular facing sheet is thereby temporarily secured to said first pair of purlins, said first rectangular facing sheet extending between said pair of purlins and extending from one end of said pair of purlins to the other.

(e) permanently securing said first rectangular facing sheet to said first pair of purlins by installing said permanent fastening means along the sides of said first rectangular facing sheet, said permanent fastening means being installed through said reinforcing members and penetrating said first pair of purlins, each of said purlins having a lower flange, and an underside of the lower flange, there being an outer portion to the underside of the lower flange when said pair of purlins is viewed together, said permanent fastening means attaching said first rectangular facing sheet through said reinforcing members to the outer portions of the bottom sides of the lower flanges of said pair of purlins to permit a subsequently installed rectangular facing sheet to overlap when attached to a common purlin;

(f) permanently securing the ends of said first rectangular facing sheet to said beams supporting the ends of said pair of purlins by first applying said tape to said beams, each of said beams being an I-beam with an upper flange and an underside to the upper flange, said tape adhering the ends of said first rectangular facing sheet to the undersides of the upper flanges of said I-beams, said permanent fastening means then being installed through said reinforcing members, running along the ends of said first rectangular facing sheet, into the undersides of the upper flanges of said I-beam;

(g) attaching the remaining number of said rectangular facing sheets to the remaining pairs of said purlins by repeating steps (d), (e) and (f), above, to install each of said rectangular facing sheets, the result being the creation of a facing construction which provides a continuous vapor impermeable surface across the entire ceiling area spanned by said purlins, said facing construction being securely attached along the edges of the ceiling and being made up of a number of said rectangular facing sheets joined together along the sides thereof at said common purlins, providing vapor impermeable overlapping joints at said common purlins;

(h) installing insulation on top of said facing construction; and (i) installing a rigid roofing material on top of said purlins over said insulation.

12. The method of claim 11 wherein the step of installing insulation includes:

(a) installing two layers of insulation on top of said facing construction, said insulation running in a direction perpendicular to said purlins, said insulation having been cut to fit between said purlins;

(b) installing an uppermost third layer of insulation on top of said first two layers of insulation, said uppermost layer being laid across the top of the purlins in a direction perpendicular thereto.

* * * * *